US005313744A

United States Patent [19]

Shank, Jr.

[11] Patent Number: 5,313,744

[45] Date of Patent: May 24, 1994

[54] WATER SCREEN FOR BLAST MEDIA DUST CONTAINMENT

[75] Inventor: James D. Shank, Jr., Vestal, N.Y.

[73] Assignee: Church & Dwight Co., Inc., Princeton, N.J.

[21] Appl. No.: 13,073

[22] Filed: Feb. 3, 1993

[51] Int. Cl.[5] ..... B24B 1/00

[52] U.S. Cl. ..... 51/317; 51/319; 51/270; 51/424; 51/425

[58] Field of Search ..... 51/424, 425, 410, 317, 51/320, 321, 270, 266

[56] References Cited

U.S. PATENT DOCUMENTS

| | | | |
|---|---|---|---|
| 2,520,627 | 8/1950 | Dick | 51/270 |
| 3,651,607 | 3/1972 | Lee, II | 51/270 |
| 3,803,997 | 4/1974 | Van Raden | 98/115 SB |
| 3,898,059 | 8/1975 | Foster | 55/94 |
| 4,811,526 | 3/1989 | Roestenbas | 51/270 |
| 5,127,199 | 7/1992 | Blankers et al. | 51/425 |
| 5,135,550 | 4/1992 | Telchuk et al. | 55/84 |

FOREIGN PATENT DOCUMENTS

| | | | |
|---|---|---|---|
| 3115841 | 11/1982 | Fed. Rep. of Germany | 51/270 |

*Primary Examiner*—M. Rachuba

*Attorney, Agent, or Firm*—Charles B. Barris

[57] ABSTRACT

A dust containment system for removing dust from the environment of a workpiece which is being blast cleaned comprises a water screen including a downwardly flowing curtain of water placed in the path of deflected blast media from the workpiece, a rearward wall spaced from the water screen and also in the path of the deflected stream of blast media and means to remove the blast media from the space between the water screen and the rearward wall.

25 Claims, 2 Drawing Sheets

WATER SCREEN FOR BLAST MEDIA DUST CONTAINMENT

FIELD OF THE INVENTION

The present invention relates to improvements in blast cleaning processes in which an adherent material such as paint, scale, dirt, grease and the like is stripped from solid surfaces by means of a particulate abrasive. In particular, the present invention is directed to a method of blast cleaning a substrate within a blast chamber and, more particularly, to a novel means for containing the dust within such chamber during the blast cleaning process.

BACKGROUND OF THE INVENTION

In order to clean a solid surface so that such surface can again be coated such as, for example, to preserve metal against deterioration, remove graffiti from stone or simply to degrease or remove dirt from a solid surface, it has become common practice to use an abrasive blasting technique wherein abrasive particles are propelled by a high pressure fluid against the solid surface in order to dislodge previously applied coatings, scale, dirt, grease or other contaminants. Various abrasive blasting techniques have been utilized to remove coatings, grease and the like from solid surfaces. Thus, blasting techniques comprising dry blasting which involves directing the abrasive particles to a surface by means of pressurized air typically ranging from 30 to 150 psi, wet blasting in which the abrasive blast media is directed to the surface by a highly pressurized stream of water typically 3,000 psi and above, multi-step processes comprising dry or wet blasting and a mechanical technique such as sanding, chipping, etc. and a single step process in which both air and water are utilized either in combination at high pressures to propel the abrasive blast media to the surface as disclosed in U.S. Pat. No. 4,817,342, or in combination with relatively low pressure water used as a dust control agent or to control substrate damage have been used. Water for dust control has been mixed with the air either internally in the blast nozzle or external of the nozzle at the targeted surface to be cleaned and such latter process, although primarily a dry blasting technique, is considered wet blasting inasmuch as media recovery and clean up is substantially different from that utilized in a purely dry blasting operation.

The blast media or abrasive particles most widely used for blasting surfaces to remove adherent material therefrom is sand. Sand is a hard abrasive which is very useful in removing adherent materials such as paint, scale and other materials from metal surfaces such as steel. While sand is a most useful abrasive for each type of blasting technique, there are disadvantages in using sand as a blast media. For one, sand, i.e., silica, is friable and upon hitting a metal surface will break into minute particles which are small enough to enter the lungs. These minute silica particles pose a substantial health hazard. Additionally, much effort is needed to remove the sand from the surrounding area after completion of blasting. Still another disadvantage is the hardness of sand itself. Thus, sand cannot readily be used as an abrasive to remove coatings from relatively soft metals such as aluminum or any other soft substrate such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to sand as a blast media, particularly, for removing adherent coatings from relatively soft substrates such as softer metals as aluminum, composite surfaces, plastics, ceramic tile, concrete and the like is sodium bicarbonate. While sodium bicarbonate is softer than sand, it is sufficiently hard to remove coatings from aluminum surfaces and as well remove other coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm. Since sodium bicarbonate is water soluble and is benign to the environment, this particular blast media has found increasing use in cleaning dirt, grease and oil and the like from hard surfaces such as steel as well as interior surfaces such as those which contact food such as in environments of food processing or handling.

Sodium bicarbonate is also a friable abrasive and, like sand, will form a considerable amount of dust during the blast cleaning process. To control the dust formed by the sodium bicarbonate blast media as it contacts the targeted surface, water has been included in the pressurized fluid carrier medium. Thus, water has been used as the primary carrier fluid or, more preferably, injected into a pressurized air stream which carries the blast media from the blast nozzle to the targeted surface. Water as a means to control dust has been mixed with the air stream internally in the blast nozzle or into the air stream externally of the nozzle. The addition of water to the pressurized air stream has been very effective in controlling dust formed by the sodium bicarbonate blast media. However, the addition of water can reduce productivity and, thus, purely dry blast cleaning processes are widely used.

Water has also been used as a dust control agent utilizing sand as the blast media. Moreover, most of the blast media which is utilized including the harder abrasives such as sand or alumina and the softer abrasives including the water soluble blast media such as sodium bicarbonate, sodium sulfate, sodium silicate and water insoluble soft media such as plastics, corn cobs, rice hulls, walnut shells, etc., are friable and will form a considerable amount of dust as the blast media contacts the targeted surface and strips the adherent contaminants therefrom. In an outdoor environment, the use of water as the carrier fluid or the addition of water to the pressurized air stream is useful in removing the dust formed during blast cleaning from the immediate environment of the substrate and the operator who is performing the blasting. Any dust which is not contained and removed disperses throughout the environment.

The use of blast chambers to strip contaminants from the surfaces of articles, in particular, articles which are of relatively small size is an important technique of cleaning such articles especially if blast cleaning is done on a regular basis. For example, automobile manufacturers use blast chambers to clean auto parts such as door panels, hoods, trunk tops, bumpers, etc. which have been over or unevenly painted for repainting. Blast equipment manufacturers and blast media formulators constantly test products in blast chambers. Thus, if blast cleaning is done on a regular basis, it is important to control noise levels, capture, examine and, if possible, recycle used abrasive media and control the dust which is formed so as to provide for the visibility of the blast nozzle operator. Dust control in blast chambers is extremely important in view of the enclosed environment which is used for the cleaning process. In the more enclosed environment of a blast chamber, the use of a secondary water stream does not effectively control the dust and, may in fact, add to visibility problems by forming a mist which stagnates in the chamber. Additionally, as before-said, the use of a secondary water stream for dust control may reduce the productivity of stripping and, thus, it may be desired to blast clean using a purely dry blast cleaning process. In a dry blast cleaning process, a considerably large amount of dust engulfs the environment of the target substrate. Accordingly, there is a continuing need to contain dust from blast cleaning operations, in particular, when such blast cleaning is done within a blast chamber.

It is well known to capture paint overspray whether as a liquid or as a powder by use of water curtains which are placed behind the substrate being painted. The curtains are provided by directing water downward on a flat support to form a coherent sheet of water which catches the paint particles or droplets. In blast cleaning operations, however, the abrasive blast media particles are orders of magnitude more massive than paint and the pressurized fluid which directs the blast media to the substrate is provided at a substantially greater volume than that used for paint spraying. Presently, many painting procedures even use airless systems. Consequently, the momentum of the blast media-/air mixture is orders of magnitude greater than that found in painting systems such that mere water curtains are not sufficient to capture much of the deflected media and dust formed therefrom. Blast media effluent would literally pass through the water curtain and deflect off the support surface without being captured.

Accordingly, it is the primary objective of the present invention to provide a means for controlling the dust which is formed by blast cleaning a substrate in a relatively enclosed environment.

Another object of the present invention is to provide a means for dust containment and capture for use in an enclosed blast chamber which is relatively easy to manufacture, install and use.

Still another object of the present invention is to provide an improved process for blast cleaning articles within the confines of a blast chamber and whereby the dust formed during the blast cleaning process is readily removed from the environment of the operator and workpiece and eventually removed from the interior of the blast chamber.

SUMMARY OF THE INVENTION

In accordance with the present invention, a blast chamber used for blast cleaning articles with an abrasive blast media entrained in a pressurized fluid stream is provided with a dust containment system which effectively captures and removes from the chamber the effluent blast media particles and stripped contaminants deflected from the targeted substrate. The dust containment system comprises a forward water screen in the form of a downward flowing curtain spaced from the targeted substrate and positioned in the path of the deflected blast media and stripped contaminants and a rearward solid surface spaced from the water screen and also positioned in the path of the deflected abrasive media or dust which passes through the water screen to deflect same into the space between the water screen and the wall. Upon passing initially through the water screen and contacting the rearward solid wall, the velocity of the media effluent and dust formed from the abrasive blast media and stripped contaminants is greatly reduced and the air stream is greatly dispersed such that all effluent and dust is contained in the capture space between the water screen and the rearward solid surface or finally captured in the water screen. An air ventilation system above the capture space or a dust collecting system at the bottom of the capture space is used to draw off the dust from the chamber. Likewise, water from the water screen is collected in a pan below a grated floor. Desirably, the water is filtered to remove solids and again pumped to a manifold for delivery of the water to form the water screen. The water screen may be a self supporting curtain, but, preferably is formed on the surface of a foraminous structure to ensure the water screen is in the form of a coherent sheet of water which effectively traps the blast effluent. Likewise, the rearward solid surface spaced from the water screen may also contain a water curtain flowing down the surface thereof to capture any dust and direct same to a collection means at the bottom of the blast chamber.

DETAILED DESCRIPTION OF THE INVENTION

Figure 1:
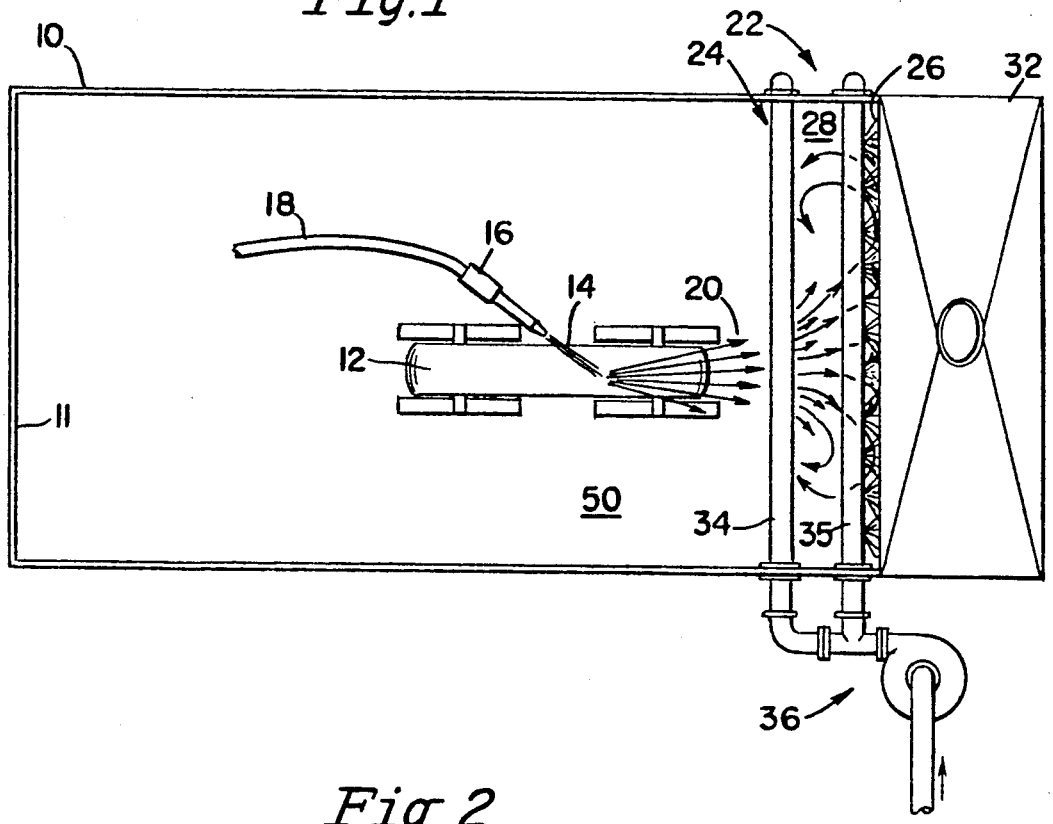
FIG. 1 is a top plan view of a blast chamber containing the dust containment structure of the present invention.
Figure 2:
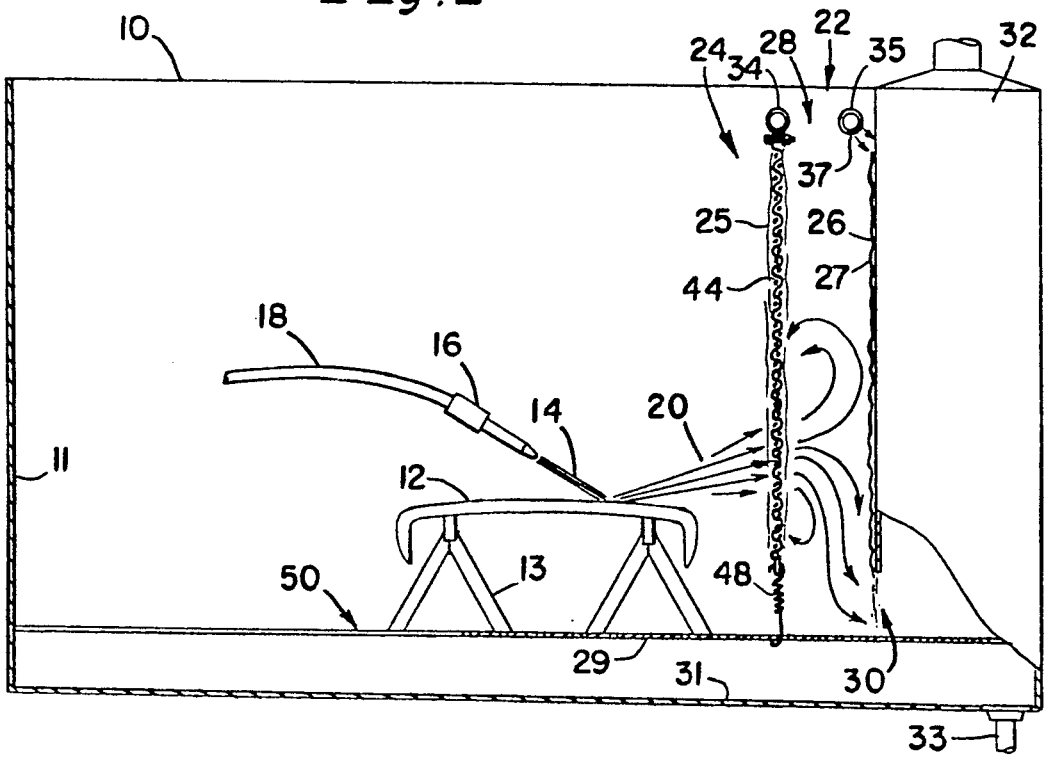
FIG. 2 is a side plan view of the blast chamber containing the dust containment system of the present invention.

Referring to FIGS. 1 and 2, blast chamber 10 surrounds and holds workpiece 12 which is to be blast cleaned. While blast chamber 10, shown in FIG. 1, is a totally enclosed chamber, the dust containment system of the present invention is useful in confining environments which may not be entirely enclosed but in which dust accumulation poses a substantial problem. For example, a chamber 10 without rear wall 11 would still be plagued by substantial stagnate dust. Thus, enclosed environment is meant to include any confined environment in which blast effluent cannot readily dissipate. Three-sided booths are an example of such a confined environment. Workpiece 12 as exemplified by a car bumper in the drawings can be carried into blast chamber 10 manually or a conveyor type system (not shown) can be used to direct workpiece 12 into and out of chamber 10. Similarly, workpiece 12 can be supported by any conventional support means as exemplified by the horse supports 13. The means for directing workpiece 12 into and out of blast chamber 10 and the means to support workpiece 12 during blast cleaning are not part of the present invention, per se, and any conventional conveying system whether manual or automated and workpiece support means can be utilized in the blast chamber and with the dust containment system of the present invention. Workpiece 12 is blast cleaned by means of a blast media stream 14 directed against workpiece 12 with a blast nozzle 16. Typically, pressurized air and a blast media in the form of abrasive particles are mixed prior to entering blast nozzle 16 and are carried from a mixing means (not shown) which entrains the abrasive blast particles within the air stream. The mixture is conveyed from the mixing means to blast nozzle 16 by means of a hose 18. Blast nozzle 16 can be hand-held and operated manually or blast nozzle 16 can be supported and controlled mechanically. Again, the means for operating blast nozzle 16 does not form a part of the present invention and any method or means of manipulating blast nozzle 16 to direct the blast media stream 14 against workpiece 12 is applicable with the dust containment system of the present invention.

Upon contacting the surface of workpiece 12, blast media stream 14 strips contaminants from the surface of workpiece 12 and along with such contaminants is deflected from the workpiece 12 in the form of deflected stream 20. Because the blast media particles are typically friable, upon contacting the surface of workpiece 12, the individual abrasive particles break into minute pieces. Thus, deflected stream 20 is comprised of minute particles of the abrasive blast media along with particles of the contaminants which are removed from workpiece 12 as well as most of the air stream. The particles contained within deflected stream 20 move at a high velocity due to being entrained within a pressurized air stream which is accelerated through blast nozzle 16 to workpiece 12. This deflected stream 20 formed of minute particles will form a considerable amount of dust which would rapidly fill blast chamber 10 unless some means is used to remove the dust and to separate the dust from the immediate environment of blast nozzle 16 and workpiece 12.

In accordance with the present invention, a dust control system generally indicated by reference numeral 22 is incorporated within blast chamber 10. Dust containment system 22 includes a forward water screen 24 which is in a position to intercept the deflected blast media stream 20 and a rearward wall 26 which is spaced from water screen 24. In operation, the deflected blast media stream 20 contained of blast particles, contaminent particles and air has sufficient mass and velocity to initially pass through water screen 24 including water curtain 25. The particles which pass through water screen 24 contact wall 26 and are again dispersed and deflected toward the water screen. However, the momentum of the deflected stream 20 is substantially reduced by dispersal of the air and contact of the particles as stream 20 passes through the water screen 24 and is again deflected off of wall 26 that the particles which are deflected from wall 26 cannot again penetrate water screen 24 and enter the environment of the blast chamber 10. Instead, the particles are either captured by the water screen 24 or are again deflected into space 28 between the forward screen 24 and rearward wall 26. The particles contained within space 28 can be removed such as through a space 30 at the bottom of rearward wall 26 and directed to a scrubber 32 to separate the particulates from the air stream. Water which forms water curtain 25 flows through grated floor area 29, part of subfloor 50 and into collection pan 31. The water can be removed from pan 31 via outlet 33 and then be optionally recycled to form the water screen. Although not shown, a vacuum chamber can be placed at the top of the dust containment system 22 and space 28 so as to ventilate any accumulated dust within space 28, if desired.

Water screen 24 can be a free flowing water curtain 25. It is preferred, however, to support water curtain 25 on a solid foraminous surface 44 to ensure the formation of a coherent and continuous wall of water along the entire height of the blast chamber 10. Also, wall 26 may be a solid wall, but, preferably, is a solid rearward wall which also has a curtain of water 27 flowing down the surface thereof and which further slows the deflected blast media stream 20. Water curtain 27 also provides an additional method of withdrawing the dust from space 28 and dust chamber 10 as the water with entrained particles is directed through grate 29 and into collection pan 31. This embodiment can be seen from the side view of the blast chamber containing the dust containment system of the present invention in FIG. 2. Water for water screen 24 and optionally for curtain 27 flowing down rearward wall 26 is provided from a supply (not shown) and pumped via pump 36 to manifold 34 and optionally manifold 35, respectively. An outlet gap 37 in manifold 35 directs water against rearward wall 26. Alternatively, spray nozzles attached to manifold 35 can be used to form water curtain 27 on rearward wall 26.

Figure 3:
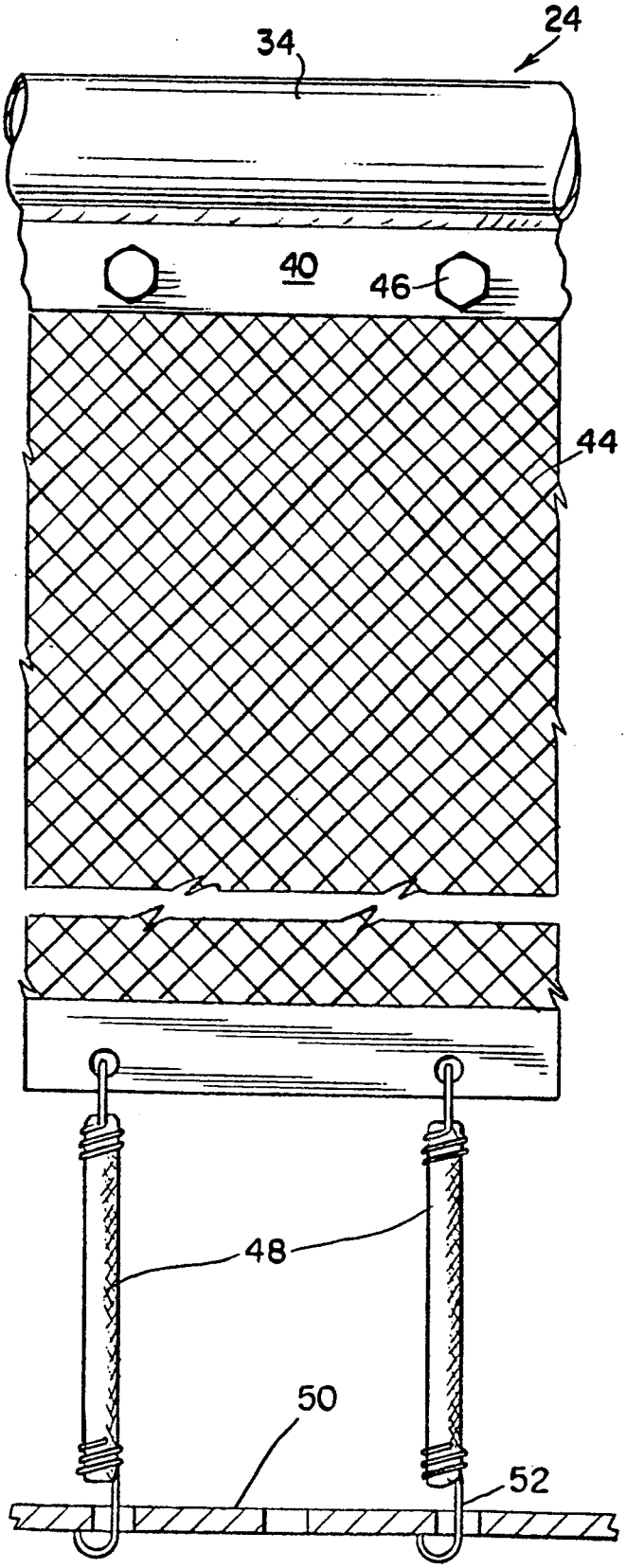
FIG. 3 is a front plan view of the means used to form the forward water screen used in the dust containment system.
Figure 4:
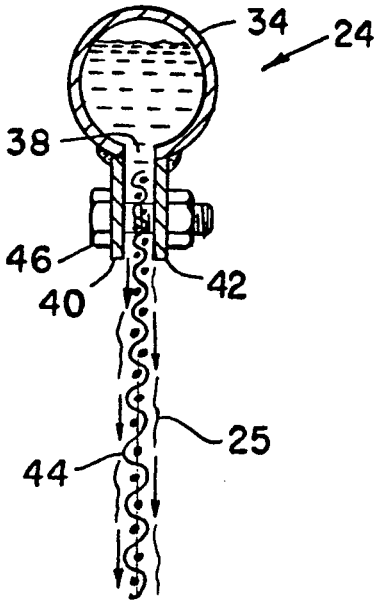
FIG. 4 is a cross-sectional view of the water screen.

In FIGS. 3 and 4, a preferred water screen 24 is illustrated. As shown therein, water screen 24 includes a pipe manifold 34 which is provided water from a pump 36 as shown in FIG. 1 Pipe manifold 34 includes slit or an outlet opening 38 along the length of the manifold which covers substantially the full width of the blast chamber 10. Welded or otherwise attached to manifold 34 on opposite sides of gap 38 are water channeling bars 40 and 42 which direct the water from opening 38 of pipe manifold 34 into a continuous and coherent curtain 25 from the top to the bottom of blast chamber 10. To further ensure that the water screen 24 produces a continuous and coherent curtain 25, it has been found preferable to support the water curtain 25 on a foraminous solid support such as the rectilinear screen 44. The rectilinear support screen 44 is placed under outlet gap 38 and attached to the water channelling bars 40 and 42 such as by attachment bolts 46. It has also been found useful to support the bottom of the water curtain support screen 44 by an attachment means which as shown in FIG. 3 is in the form of a pair of flexible cords 48 which are hooked to subfloor 50 in grated area 29 of blast chamber 10 by means of hooks 52.

Channelling bars 40 and 42 are a most useful component of water screen 24. These bars, preferably formed of metal or plastic, extend from the bottom of manifold 34 and on either side of outlet gap 38 downward at least long enough to allow formation of a coherent film of water which passes down support screen 44 as a coherent curtain 25. It has been found that with certain water pressures, in the absence of the water channeling bars 40 and 42, the water which leaves the outlet gap 38 tends to rapidly disperse and essentially form a spray or a very noncontinuous water stream across the width of the blast chamber which does not effectively slow down the deflected blast media stream 20 nor capture the dust particles which are again deflected from wall 26.

The dust containment system of the present invention can be used in blast chambers to remove contaminants from solid surfaces using any type of abrasive blast media. Thus, heavier or more dense abrasive particles such as sand can be used as well as lighter, less dense materials such as water soluble abrasive particles including sodium bicarbonate. Other nonlimiting examples of abrasive particles which can be used beneficially in conjunction with the dust containment system of this invention include harder abrasives such as alumina and softer abrasives such as water soluble blast media including sodium silicate, sodium sulfate and water insoluble softer media such as plastics, corn cobs, rice hulls, walnut shells, calcium carbonate, etc.

The blast cleaning process used also does not adversely affect performance of the dust containment system. Thus, wet blasting, dry blasting with addition of water to control dust and purely dry blast cleaning can be effectively employed with a blast chamber containing the water screen 24 and rearward surface 26.

The dust containment system of the present invention may operate with one water screen or a plurality of such water screens. Thus, it may be possible to set up a three sided water screen in a larger room area using a three-sided trough under the screens. The screened-in area would be free from dust and allow the operator to work in a clean environment.

What is claimed is:

1. A dust containment system for use in a blast cleaning process comprises: a water screen including a means to form a water curtain positioned in the path of a deflected particulate-containing blast media stream, a rearward wall spaced from said water screen and in the path of the deflected blast media which passes through said water screen, and means for removing particulates from said space between said water screen and said rearward wall.

2. The dust containment system of claim 1 wherein said water screen includes a foraminous support means and said means to form a water curtain directs water onto said foraminous support means.

3. The dust containment system of claim 2 wherein said foraminous support means is a rectilinear screen.

4. The dust containment system of claim 1 including means to form a curtain of water on said rearward wall.

5. The dust containment system of claim 1 wherein said water screen and rearward wall are contained within a confined area.

6. The dust containment system of claim 5 wherein said confined area includes a water collection means below said water screen.

7. The dust containment system of claim 5 wherein said confined area is a substantially enclosed chamber.

8. The dust containment system of claim 1 wherein said particulate removal means includes a means to separate said particulates from air.

9. The dust containment system of claim 1 wherein said means to form a water curtain comprises an upper water supply means and a downwardly facing outlet passage in said upper water supply means to cause the water to flow as a downward curtain.

10. The dust containment system of claim 9 wherein said water supply means is a water manifold positioned across the path of said deflected blast media, said outlet passage comprises a gap in said water manifold along the length of said water manifold.

11. The dust containment system of claim 10 including a pair of vertically oriented guide means attached to said water manifold on opposite sides of said gap, said guide means extending from said water manifold means downwardly a sufficient distance to aid in forming a coherent curtain of water.

12. The dust containment system of claim 11 wherein said water screen further includes a foraminous support means positioned below said gap and extending downwardly so as to support said curtain of water.

13. The dust containment system of claim 12 wherein said foraminous support means is a rectilinear screen.

14. The dust containment system of claim 12 wherein said foraminous support means is positioned between said pair of guide means and attached to said water screen by attachment means running through said guide means and said foraminous support.

15. A process for removing coatings or other contaminants from a solid surface comprises contacting said surface with a highly pressurized stream comprising a fluid carrier and a particulate abrasive, removing the dust caused by said abrasive contacting said solid surface by passing the stream of pressurized fluid and particulate abrasive deflected from said surface into contact with a dust containment system comprising a water screen including a downwardly flowing water curtain in the path of said deflected stream, a rearward wall spaced from said water screen and in the path of said deflected stream which initially passes through said water curtain, and removing said particulates from the space between said water screen and said rearward wall.

16. The process of claim 15 wherein said water screen includes a downwardly flowing curtain of water supported on a foraminous support.

17. The process of claim 15 where a curtain of water is provided on said rearward wall.

18. The process of claim 17 comprising collecting the water from said water screen and separating any particulate material therefrom.

19. The process of claim 15 wherein said blast cleaning takes place in a substantially enclosed chamber.

20. The process of claim 15 wherein said abrasive particles are water soluble.

21. The process of claim 20 wherein said water soluble abrasive particles comprise sodium bicarbonate.

22. The process of claim 18 wherein subsequent to separating the particulates from said water, said water is recycled to said water screen to form said curtain.

23. The process of claim 15 wherein said blast cleaning takes place in a confined area.

24. The process of claim 15 wherein said abrasive particles are water insoluble.

25. The process of claim 24 wherein said water insoluble abrasive particles comprise calcium carbonate.

* * * * *